US006558083B1

(12) United States Patent
Quandt

(10) Patent No.: US 6,558,083 B1
(45) Date of Patent: May 6, 2003

(54) DOCK INSTALLATION AND REMOVAL APPARATUS AND METHOD

(76) Inventor: Eric F. Quandt, 870 Private Rd., Winnetka, IL (US) 60093

( * ) Notice: Subject to any disclaimer, the term of this patent is extended or adjusted under 35 U.S.C. 154(b) by 75 days.

(21) Appl. No.: 09/821,854

(22) Filed: Mar. 30, 2001

(51) Int. Cl.[7] ..... B63C 3/06; B63C 7/00; E02B 3/20

(52) U.S. Cl. ..... 405/218; 405/3; 405/220; 114/44; 187/213; 254/283

(58) Field of Search ..... 405/3, 4, 7, 218–223; 114/45, 50, 51, 44, 263; 187/213, 256, 254, 207; 254/286, 285, 264, 283; 14/69.5, 71.1, 71.3

(56) References Cited

U.S. PATENT DOCUMENTS

| | | | | |
|---|---|---|---|---|
| 2,618,124 | A | * 11/1952 | Holsten | 405/220 |
| 2,948,121 | A | * 8/1960 | Karst | 405/220 |
| 3,043,109 | A | * 7/1962 | Erickson | 405/220 |
| 3,499,541 | A | 3/1970 | Mackie | |
| 3,572,045 | A | * 3/1971 | Owen | 405/212 |
| 3,686,876 | A | * 8/1972 | Muschell | 405/220 |
| 3,747,354 | A | * 7/1973 | Macomber | 405/220 |
| 3,999,397 | A | 12/1976 | Albery | |
| 4,008,506 | A | * 2/1977 | Smith | 14/71.1 |
| 4,087,977 | A | 5/1978 | Kuhlman | |
| 4,123,912 | A | * 11/1978 | Meldrum | 405/220 |
| 4,126,006 | A | 11/1978 | Lewis | |
| 4,165,197 | A | 8/1979 | Postma | |
| 4,398,849 | A | * 8/1983 | Moran et al. | 405/221 |
| 4,645,380 | A | 2/1987 | Hambrick et al. | |
| 4,695,195 | A | 9/1987 | Brande | |
| 5,106,237 | A | 4/1992 | Meldrum | |
| 5,107,784 | A | 4/1992 | Lacy | |
| 5,108,230 | A | 4/1992 | Grootegoed | |
| 5,235,929 | A | 8/1993 | Chester et al. | |
| 5,613,339 | A | 3/1997 | Pollock | |
| 5,870,964 | A | 2/1999 | Gerber et al. | |
| 5,915,325 | A | 6/1999 | Gerber et al. | |
| 6,128,880 | A | 10/2000 | Meenan, Jr. | |

FOREIGN PATENT DOCUMENTS

| | | | | |
|---|---|---|---|---|
| EP | 502763 | * 2/1992 | | 14/71.3 |

OTHER PUBLICATIONS

Genuine ShoreStation Dock Brochure published by www.shorestation.com/pages/genuine.html printed on Jan. 24, 2001.
Tommy Docks Brochure published by www.tommydocks.com printed on Jan. 24, 2001.
The Simple System Brochure published by Tommy Docks. undated.
Lifts, Docks, Accessories Brochure published by Pier Pleasure, undated.
Dock Installation and Removal Brochure published by Pier Pleasure. undated.
Shore Station Boat Hoist Brochure published by Shore–Station Marine Division—Midwest Industries, Inc. undated.
The Green Laker Article published by The Ripon Commonwealth Press/Express in Jul. 1996.
Eklof D–500 Dock Brochure published by Norton's Dry Dock, Inc. undated.
Eklof D–100 Dock Brochure published by Norton's Dry Dock, Inc. undated.
Dock Brochure published by Porta Dock, Inc. undated.
Atlas Piers Brochure publsihed by Atlas Piers. undated.
Alumi–Span Brochure published by Alumi–Span Incorporated. undated.

* cited by examiner

*Primary Examiner*—Jong-Suk (James) Lee
(74) *Attorney, Agent, or Firm*—Bell, Boyd & Lloyd LLC

(57) ABSTRACT

An apparatus and method are provided for installing successive segments of a segmented dock. A suspension structure is connected to a previously installed segment of dock. The suspension structure includes a frame rotator for rotating a dock frame from an inverted position atop the previously installed dock segment to an extended position substantially parallel to the previously installed dock segment. The suspension structure suspends the frame in place while decking is added to the frame. Once the decking is installed, the person installing the dock may move onto the suspended segment in order to sink support poles from the suspended dock segment.

25 Claims, 6 Drawing Sheets

DOCK INSTALLATION AND REMOVAL APPARATUS AND METHOD

The present invention relates to a dock installation and removal apparatus and method which may be used by a single person to install and remove a segmented dock.

BACKGROUND OF THE INVENTION

Removable docks are mainly used in small and medium size lakes and rivers to access boats. Such docks are removable primarily because many lakes and other bodies of water tend to freeze during the winter months. If the docks remain in the water, they may be damaged.

Known dock systems are difficult and time consuming to install, and generally cannot be easily installed by a single person. Known dock installation procedures often require either floating dock segments into place and then securing the floating sections to a support structure, or building the support structure from the lake or sea bed up. This invariably requires at least one of the installers to get in the water or utilize a boat. Since most people who are interested in installing a dock wish to do so in the spring or early summer, water temperatures are often low and not conducive to the type of work necessary to install a pier. Additionally, wind and wave conditions can affect the use of a boat.

Various docks and systems and apparatus have been proposed for installation and removal of docks. Examples are set forth in U.S. Pat. Nos. 3,999,379, 4,126,006, 4,645,380 and 5,108,230. However, these systems do not allow a single person to easily and quickly install and remove a dock and, in particular, a segmented dock. Accordingly, there is a need for an apparatus and method for installing and removing a segmented a dock which may be employed by a single person without requiring the person installing the dock to enter the water, float any dock segment on the water, or utilize a boat.

SUMMARY OF THE INVENTION

The present invention relates to an apparatus for installing and removing a segment of a segmented dock. The apparatus of the present invention is used to install or remove successive dock segments. Each dock segment includes a frame and a removable deck. The frame of each dock segment is supported above the surface of the water by a number of posts resting on the lake or sea bed.

The dock installing or removing apparatus (referred to herein as the dock installing apparatus or apparatus) includes a suspension structure adapted to be mounted on a previously installed dock segment and preferably mounted directly on or to the posts which support the previously installed segment. It should also be appreciated that the apparatus of the present invention could be used to install a first dock segment by attaching the suspension structure to the ground adjacent the desired position of the first dock segment. Two hinges are used to pivotally connect the frame of the dock segment to the frame of the previously installed dock segment. The hinges enable the frame of the segment to be positioned in a first, inverted or folded position on top of the previously installed segment and rotated or pivoted to a second non-inverted, upright, unfolded or extended position wherein the frame of the segment extends horizontally in substantially the same plane as the previously installed segment.

A frame rotator, preferably in the form of a pulley and cable system is connected to the suspension structure. The frame rotator rotates the frame of the segment from the inverted position (on top of the previously installed segment) to the non-inverted position adjacent to said previously installed segment. The suspension structure is adapted to support the segment in the non-inverted position while the installer attaches the removable deck member(s) to the segment being held in the non-inverted position. After installing the deck section or member(s), the person installing the dock may walk out onto the deck members on the suspended segment that is being installed, and sink posts for supporting the suspended segment from the suspended segment itself. Once all of the posts for the suspended segment have been put in place, the apparatus may be removed, and the new segment will be self-supporting. The apparatus may then be moved out to the newly installed segment, and the process repeated to install yet another segment of dock.

In addition to the apparatus outlined above, the present invention thereby further encompasses a method of installing a segment of a segmented dock. The method may be used on segmented docks in which each dock segment includes one or more deck sections supported by a frame, having first and second ends, and supported by a number of posts. The method involves the following steps. First, the suspension structure is mounted on one or more of the support posts associated with a first previously installed segment of dock. The suspension structure supports at least one pulley above a distal end of the first segment of dock, and the pulley in turn supports a cable. The frame associated with a second dock segment is placed upside down on the first dock segment. The pair of hinges are used to pivotally join the first end of the frame associated with the second dock segment to the second end of the first dock segment. Then, a first end of the cable is suitably fastened to the second end of the frame associated with the second dock segment.

Once the cable has been secured to the second end of the frame associated with the second dock segment, the frame is rotated by pulling the second end of the cable to raise the second end of the frame. After the frame associated with the second dock segment has been rotated past the vertical position, it may be lowered into position by releasing the cable in a controlled manner. Once in the desired position, the frame associated with the second dock segment remains suspended from the suspension structure by locking the cable or tying the cable to a fixed support. Suitable deck sections or members placed on the frame associated with the second dock segment and the posts are installed in the second dock segment. The posts are then attached to the frame associated with the second dock segment to support the second dock segment and the cable is released. The suspension structure may then be removed from the previously installed dock segment. The dock removal method of the present invention reverses this procedure.

Other objects, features and advantages of the invention will be apparent from the following detailed disclosure, taken in conjunction with the accompanying sheets of drawings, wherein like numerals refer to like parts, elements, components, steps and processes. It is therefore an advantage of the present invention to provide a dock installation apparatus and method.

DETAILED DESCRIPTION OF THE INVENTION

One embodiment of the apparatus for installing a segment of a segmented dock according to the present invention is shown in FIGS. 1 to 5 and generally indicated by numeral 10, together with a segmented dock 12 in various stages of the dock installation process. The segmented dock 12 includes a first segment 14 which has been previously installed, and a second segment 16 which is in the process of being installed.

Figure 1:
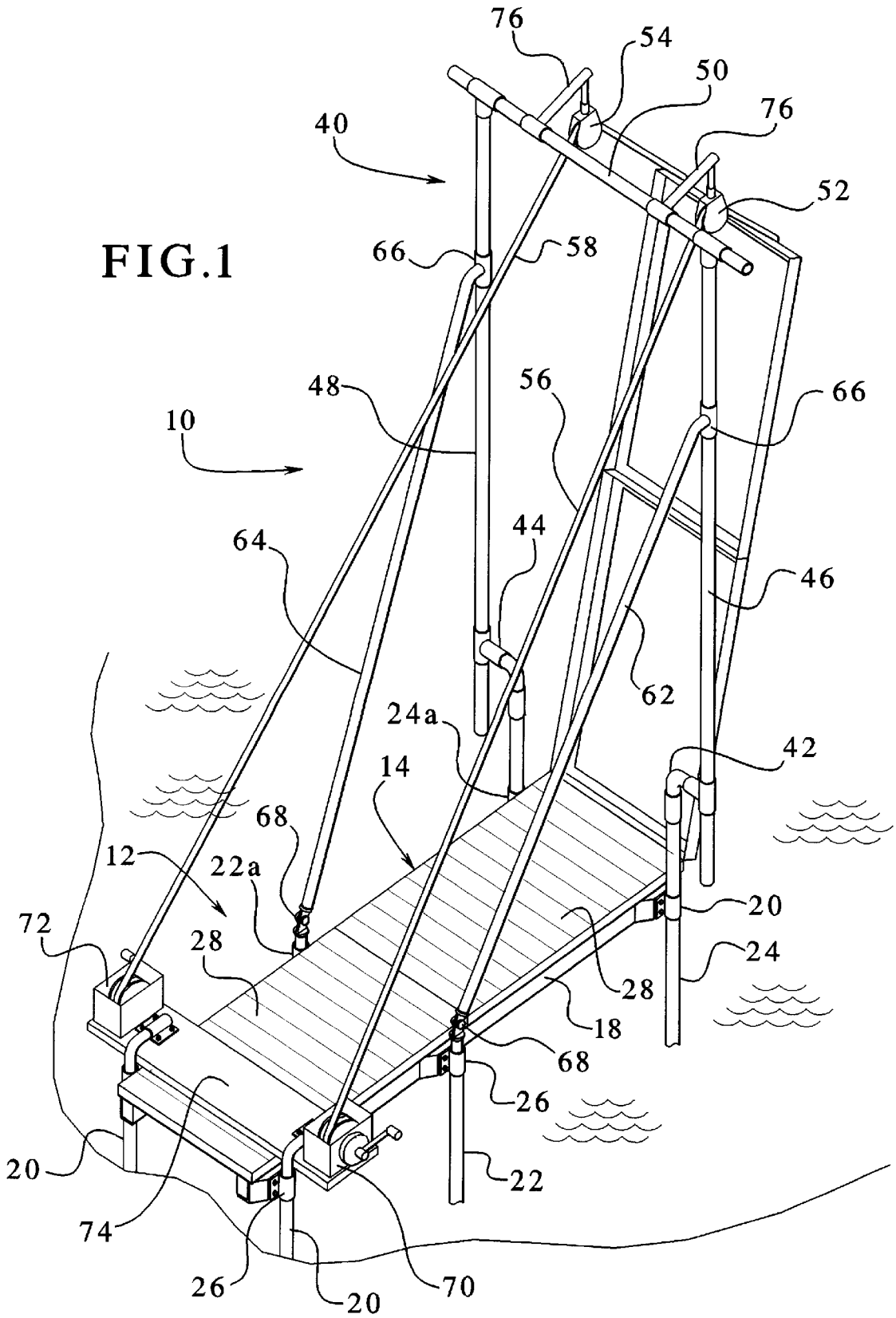
FIG. 1 is a perspective view of a segmented dock and the apparatus of one embodiment of the present invention used to install a segment of a segmented dock.
Figure 2:
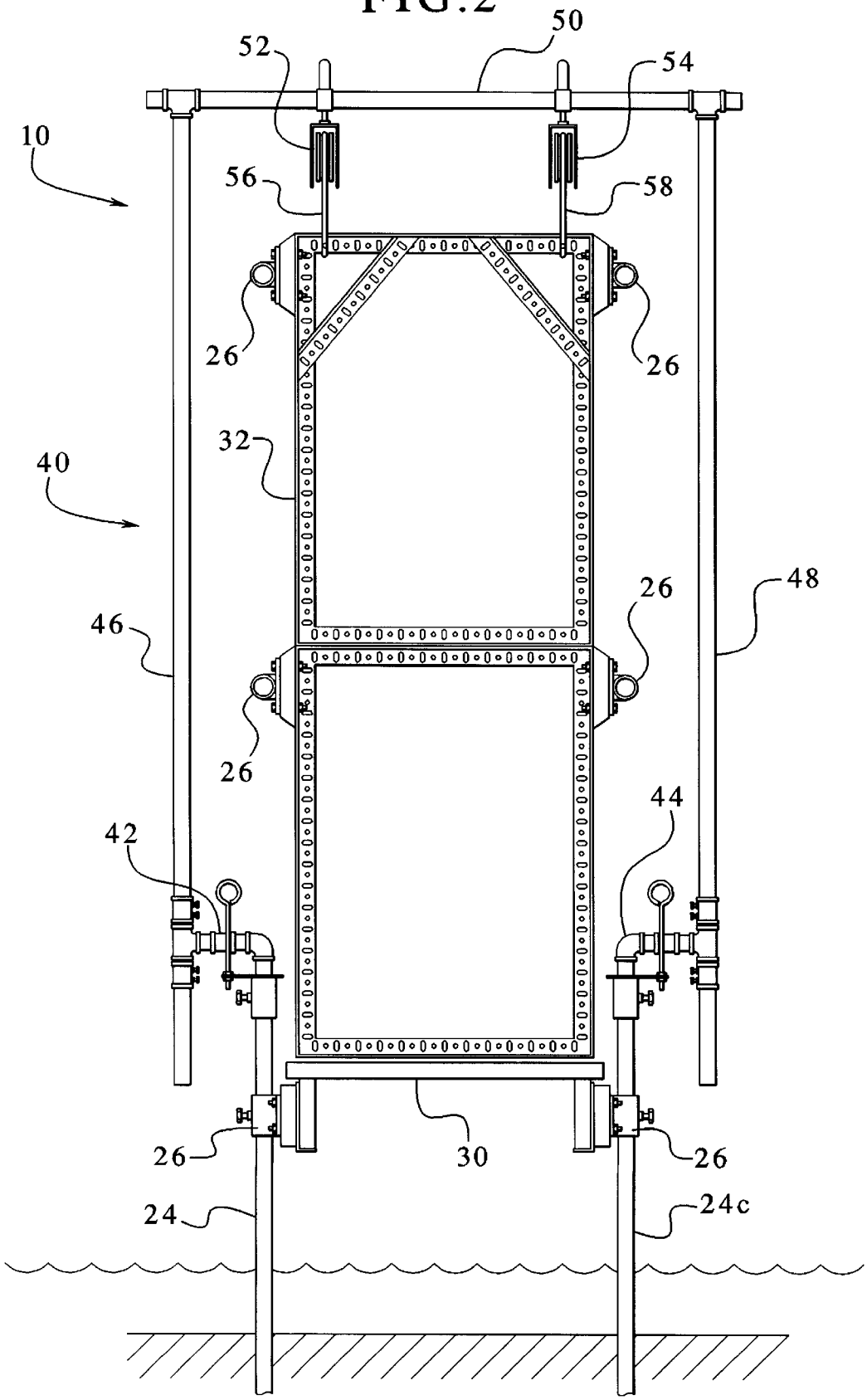
FIG. 2 is a end view of the segmented dock and the apparatus of FIG. 1.

The first dock segment 14 includes a frame 18 mounted atop posts 20, 22 and 24. Complementary posts 20*a*, 20*b* and 20*c* which can be partially seen in FIGS. 1 and 2 are also provided adjacent to posts 20, 22 and 24 on the opposite side of the dock. The posts extend downwardly to the lake or sea bed to support the first dock segment 14. Brackets 26 attach the posts to the frame 18. The decking section(s) or member (s) 28 (generally referred to as the decking section) is/are mounted to the top of the frame 18. The decking section 28 provides a generally flat surface on which a person may stand. The second dock segment 16 is substantially identical to the first dock segment 14, and includes a frame 32 to be mounted atop posts such as post 34 in the same manner as the first dock segment 14. Additional posts not shown in the drawings are provided to support the second dock segment 16 when installation of the second dock segment is complete. As with the first dock segment 14, one or more decking sections or members such as decking sections 36 are mounted on the frame 32 to support a person on the dock 10 as described below. At least one and preferably two or more hinges are employed to join the second frame 32 to the first frame 18 as described in more detail. below. The hinge enables the second frame 32 to rotate vertically through approximately 180° relative to the first dock segment 14 while remaining joined thereto. It should be appreciated that the frame does not need to rotate a full 180°.

The apparatus 10 of the present invention is provided for installing successive dock segments to dock segments that have been previously installed. Thus, as seen in FIGS. 1 to 5, the dock installation apparatus 10 is mounted to the posts 20, 20*a*, 22, 22*a*, 24 and 24*a* of the previously installed dock segment 14. The installation apparatus 10 includes a suspension structure 40 which is mounted to posts 24 and 24*a*, both of which support the distal end of the previously installed dock segment 14. A pair of offset mounting brackets 42 and 44 connect the posts 24 and 24*a* to the suspension structure 40. The offset mounting brackets 42 and 44 are configured to attach to the upper ends of the posts, extending outwardly so that the suspension structure itself is wider than the dock 12. First and second vertical risers 46 and 48 extend upwardly from the offset mounting brackets 42 and 44, respectively. A horizontal cross member 50 joins the upper ends of the vertical risers 46 and 48, and supports a pair of pulleys 52 and 54 above the distal end of the previously installed dock segment 14.

Figure 3:
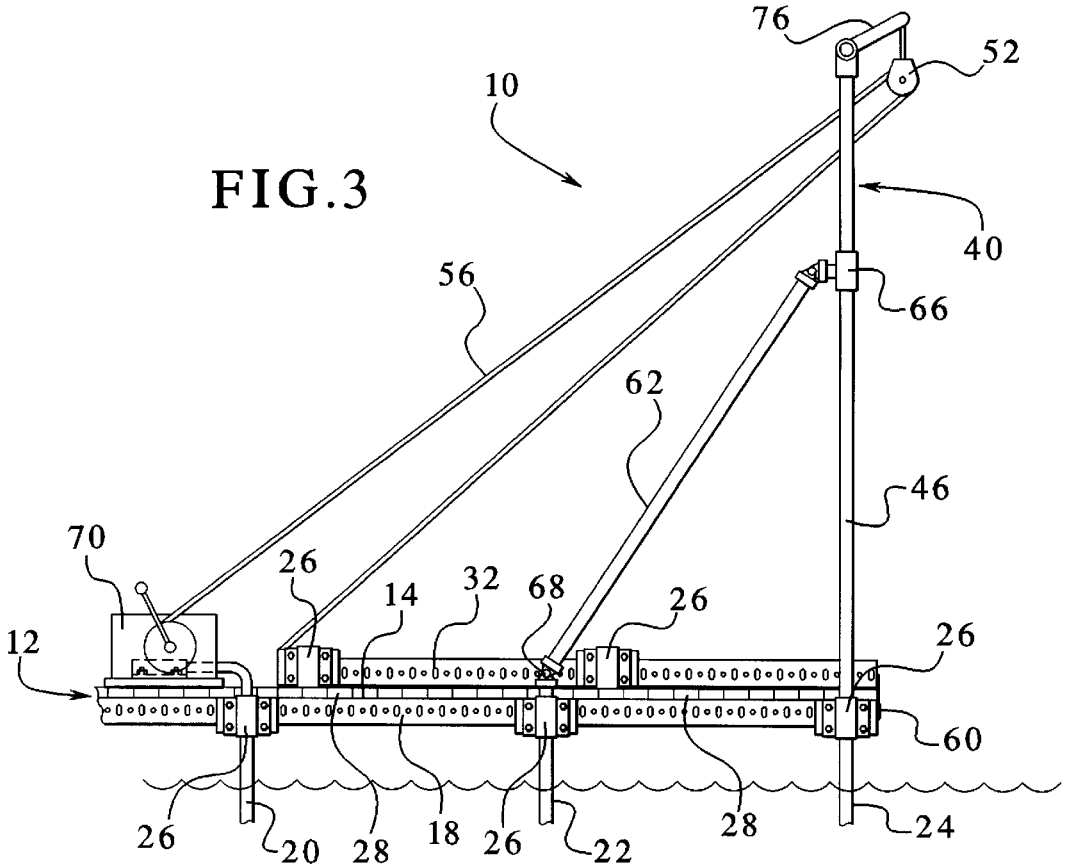
FIG. 3 is a side elevational view of the apparatus of FIG. 1 showing a frame of the segmented dock in a first inverted position on a previously installed segment of the dock.
Figure 4:
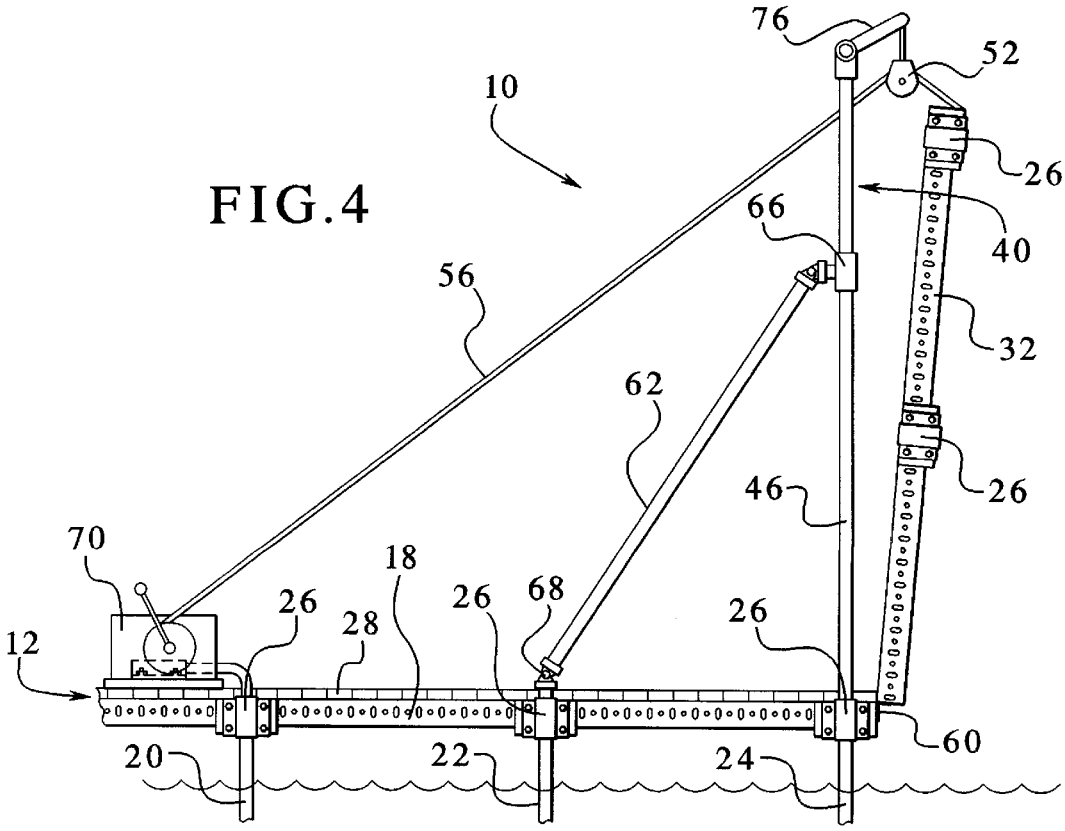
FIG. 4 is a side elevational view of the apparatus of FIG. 1 mounted on a previously installed segment of dock, showing the frame in a partially rotated position.
Figure 5:
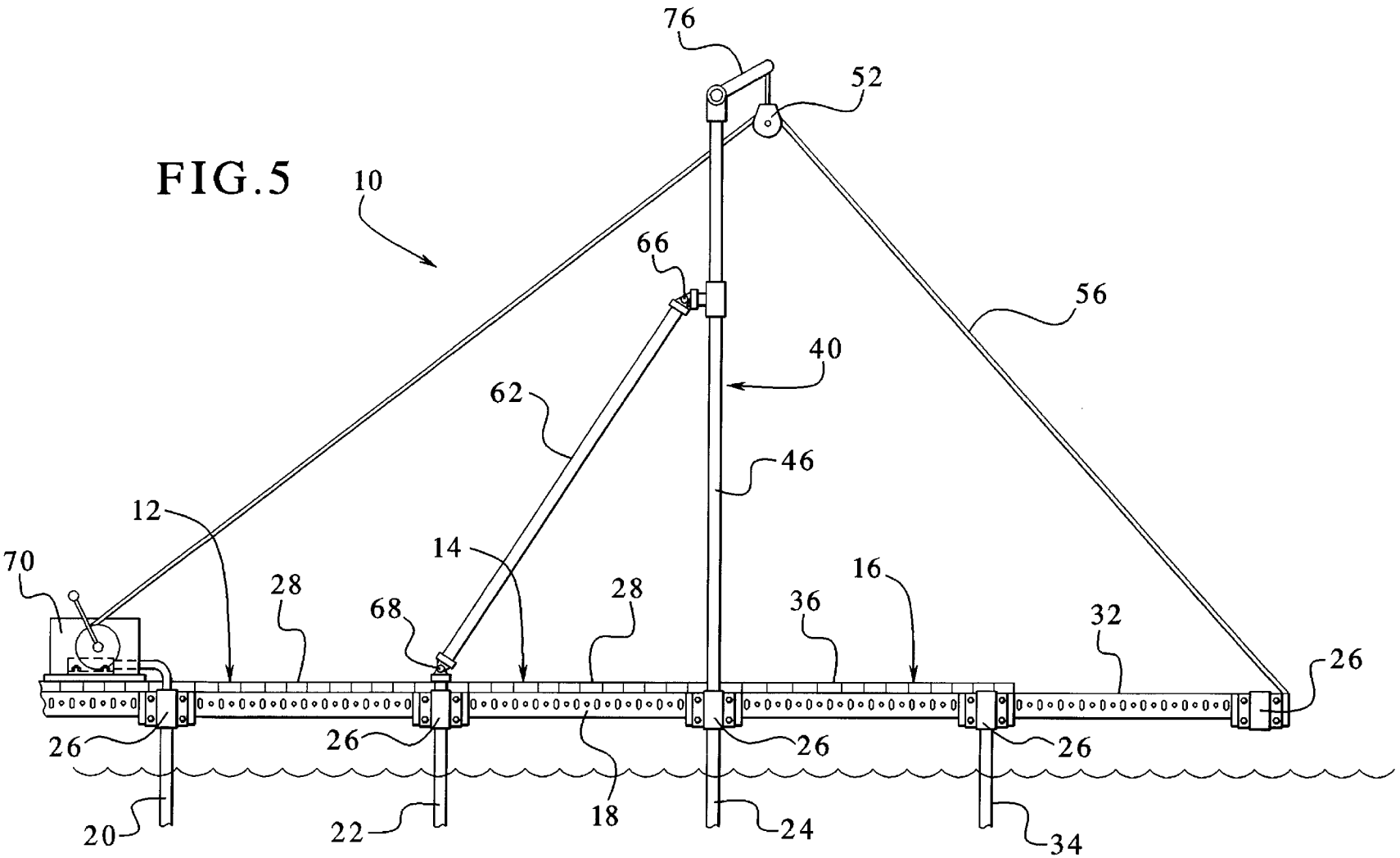
FIG. 5 is a side elevational of the apparatus of FIG. 1 mounted on a previously installed segment of dock, showing the frame in a final horizontal or non-inverted position.

The suspension structure 40 may include first and second stabilizing beams 62 and 64 attached at an intermediate point along the length of the vertical risers 46 and 48, respectively. The opposite ends of the stabilizing beams 62 and 64 are mounted on the top of the posts supporting either the middle or the proximal end of the previously installed dock segment 14. In the embodiment shown, a first pair of stabilizing beam upper mounting brackets 66 is provided for attaching the stabilizing beams 62 and 64 to the vertical risers 46 and 48, and a second pair of stabilizing beam lower mounting brackets 68 is provided for attaching the stabilizing beams to the mounting posts 26 and 26*a*. Further, as best seen in FIGS. 3, 4 and 5, the vertical risers 46 and 48, and/or the horizontal cross member 50 may include outwardly angled projections or extenders 76. The projections or extenders 76 enable the pulleys 52 and 54 to be mounted outwardly above the distal end of the previously installed dock segment 14. In the embodiment shown, the projections or extenders 76 extend from the horizontal cross member 50. In an alternative embodiment, the upper ends of the vertical risers 46 and 48 may be angled outwardly so that the entire horizontal cross member 50 is supported outwardly above the distal end of the previously installed dock segment 14.

The dock installation apparatus 10 also includes first and second cables 56 and 58 and first and second winches 70 and 72. The first cable 56 is wound onto the first winch 70 and pulled through the first pulley 52. The free end of the first cable 56 may then be secured to the distal end of the frame 32 of the second dock segment 16 which is being installed. Similarly, the second cable 58 is wound onto the second winch 72 and pulled through the second pulley 54. The free end of cable 58 may then also be secured to the distal end of the frame 32, preferably in an opposite corner from where the first cable 56 is secured. The winches 70 and 72 may be mounted together on a board 74 which itself may be mounted to the tops of the posts supporting the proximal end of the previously installed dock segment such as posts 20 and 20*a* as shown in FIG. 1. Alternatively, the individual winches 70 and 72 could be mounted directly to the tops of the posts 20 and 20*a* or could be mounted elsewhere on the previously installed segment of dock. Further, the winches 70 and 72 could be combined as a single winch, or could be omitted altogether and cables 70 and 72 could be manipulated manually. It should be appreciated that other suitable cable actuators and/or cable securing devices may be used in conjunction with the present invention.

Figure 7:
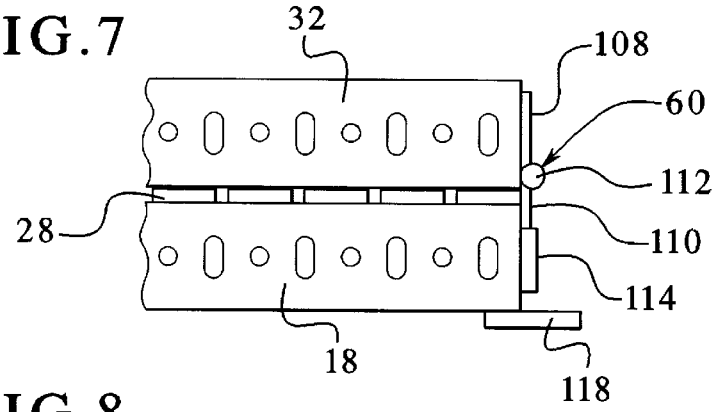
FIG. 7 is an enlarged fragmentary detailed view of the joint between frames of adjacent dock segments, with the frames in a first position and showing the hinge of one embodiment of the present invention.
Figure 8:
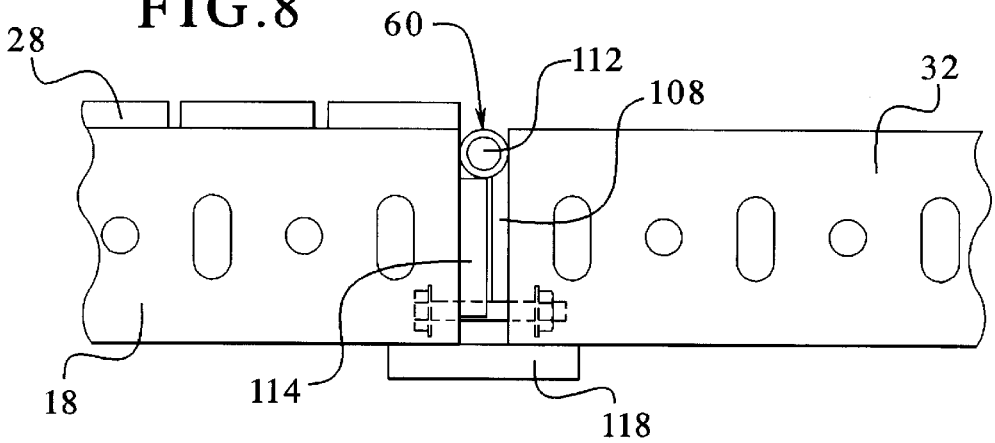
FIG. 8 is an enlarged fragmentary detailed view of the joint between frames of adjacent dock segments, with frames in a second position and showing the hinge of one embodiment of the present invention.
Figure 9:
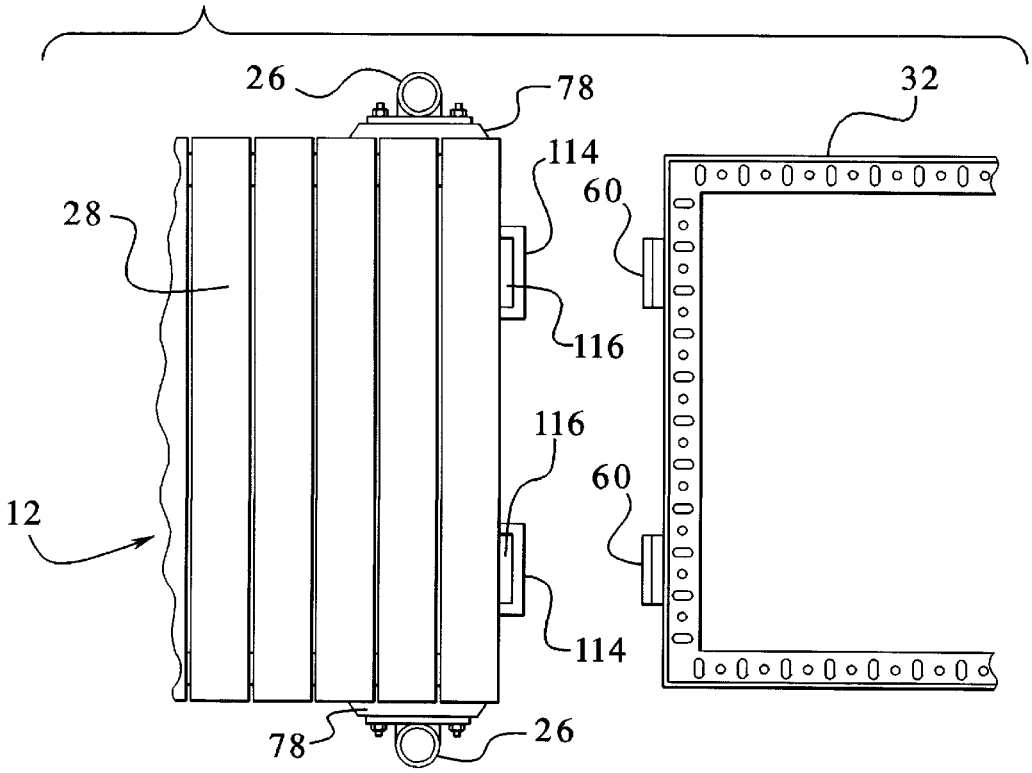
FIG. 9 is a fragmentary exploded top plan view of a previously installed dock segment and the frame of a dock segment yet to be installed.

A pair of floating leaf hinges 60 connect the frame 32 of the second dock segment 16 to the frame 18 of the previously installed dock segment 14. The floating leaf hinges 60 are shown in detail in FIGS. 7 to 9. Each hinge 60 includes first and second leaves 108 and 110 adapted to pivot about a hinge pin 112 as is commonly known in the art. The first leaf 108 may be rigidly affixed to the frame 32 of the second dock segment 16. A metal bracket 114 defines a pocket or slot 116 along the end of frame 18 of the previously installed dock segment 14. As can be seen in FIG. 9, two separate hinges 60 are provided between the frames 18 and 32, and two brackets 114 are attached at the end of frame 18. The brackets 114 are configured to receive the second leaf 110 of the hinge 60. This construction enables the second leaf 110 to float vertically within the pocket 116 while remaining secured horizontally to the frame 16 by the bracket 114. Thus, as shown in FIG. 8, the frame 32 of the second dock segment 16 may be placed in an inverted position above the previously installed dock segment 14 and the second leaves 110 of hinges 60 may be inserted into the pockets 116 defined by the brackets 114 to join frame 32 to frame 18. The frame 32 may then be rotated vertically in a clockwise direction as seen from FIG. 7, to a non-inverted substantially horizontal position as shown in FIG. 8. In this position, the second leaf 110 drops further into the pocket 116 to more firmly join the two frames. A bearing plate 118 may be bolted to the underside of the two frames 18 and 32 to further strengthen the joint between the two dock segments 14 and 16.

Figure 6:
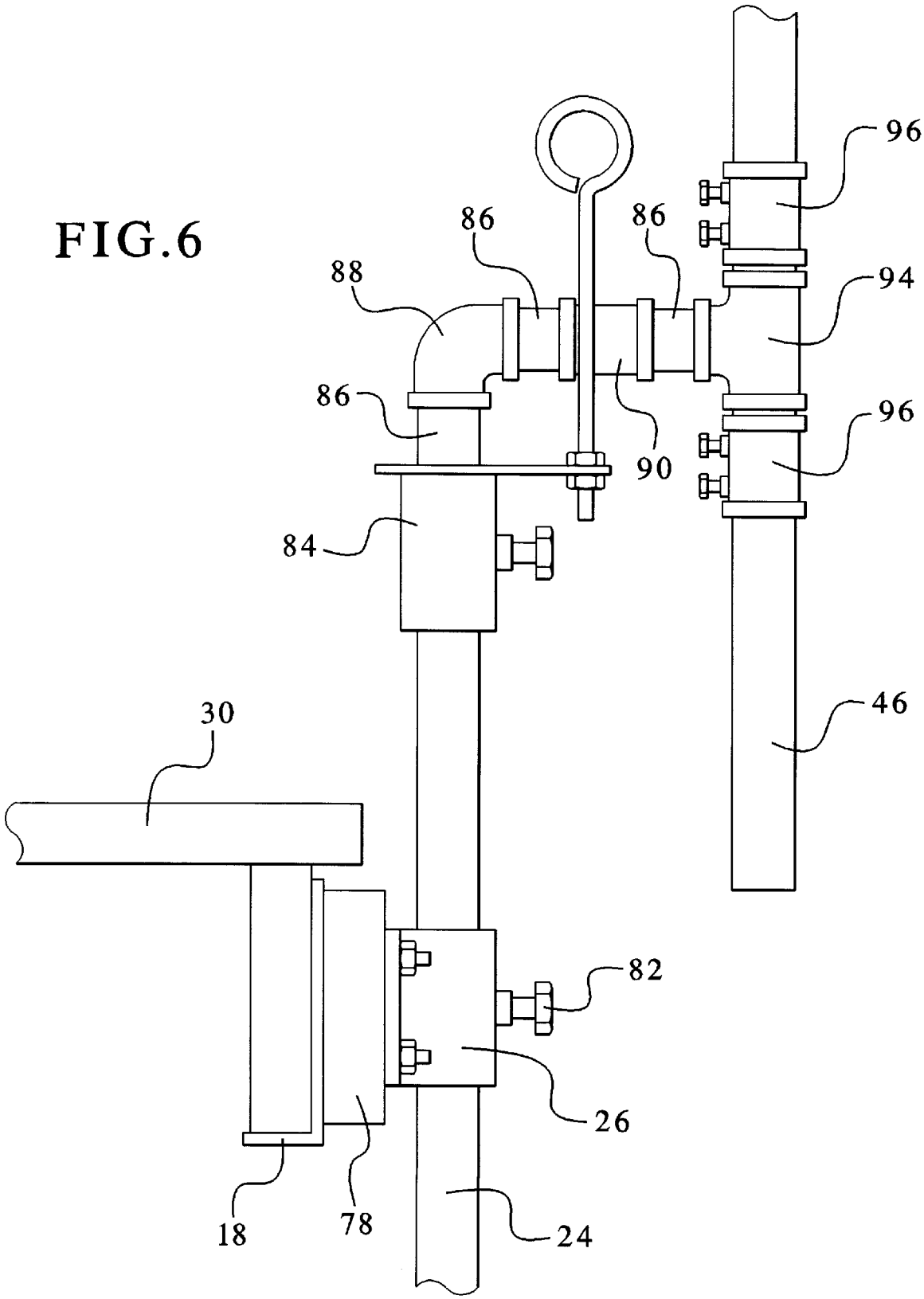
FIG. 6 is a fragmentary detailed view of one embodiment of an offset bracket used in conjunction with one embodiment of the present invention.

One of the offset mounting brackets 42 and 44 and a portion of the previously installed dock segment are shown in detail in FIG. 6. The dock segment includes the frame 18 which supports the decking section 38. A spacer 78 is mounted to the frame 18 between the frame and a post mounting bracket 26, both of which are bolted to the frame. The post mounting bracket forms a sleeve, and the post 24 is inserted through the sleeve. When the post is in the proper position, i.e. when the bottom of the post is resting on the lake or sea bed, and the upper surface of the dock is level, the frame 18 may be secured in place on the post 24 by a clamping screw 82.

The offset bracket may be assembled from conventional pipe or conduit fittings. For example, in the embodiment depicted in FIG. 6, the offset bracket comprises a first coupler 84, short nipples 86, a 90° elbow 88, a straight fitting 90, a "T" 94 and couplers 96. The first coupler 84 is provided for mounting the offset bracket on the end of post 24. The first nipple 86 connects the first coupler 84 to elbow 88, and the two horizontal nipples and the straight fitting 90 extend the bracket outwardly away from the post 24. The "T" fitting joined to the outermost horizontal nipple 86 orients the upper end of the offset bracket in vertical direction to receive the vertical riser 46. Finally, pipe couplers 96 are provided for securing the vertical riser 46 in place relative to the offset bracket 44. It should be appreciated that any suitable alternative offset bracket structure, suitable offset mounting structure or the like may be used in connection with the present invention.

Returning to FIGS. 1 to 5, the process of using the apparatus of the present invention for installing the second dock segment 16 will now be described. The frame 32 of the second dock segment 16 is placed upside down on the deck of the first, previously installed dock segment 14 as shown in FIG. 3. With the inverted frame 32 lying in the surface of the first dock segment 14, the two frames 18 and 32 are joined by the floating leaf hinges 60 as described above. Next, the free ends of the cables 56 and 58 are fastened to the distal end of the second frame 32 in opposite corners. Once the cables 56 and 58 are attached to the frame 32, the cables 56 and 58 are pulled through the pulleys 52 and 54 by winding the winches 70 and 72. The cables pull the distal end of the frame 32 upward, causing the entire frame 32 to rotate about the hinge 60.

FIGS. 1, 2 and 4 show the position of the frame 32 when the cables 56 and 58 are fully wound onto the winches 70 and 72. At that point, the frame 32 has been rotated slightly past vertical due to the fact that the pulleys are suspended outwardly from the distal end of the previously installed dock segment. The frame 32 may then be lowered into position by slowly unwinding the cables 56 and 58 from the winches 70 and 72. When the frame 32 reaches a substantially horizontal position as shown in FIG. 5, the winches 70 and 72 may be locked, so that the cables 56 and 58 remain taught and support the frame 32 in the horizontal position. A first section of decking 36 of the second dock segment 16 may then be slid into position from the previously installed dock segment 14. An individual installing the dock may then proceed out onto the deck section 36 supported by the cables 56 and 58 and the suspension structure 40. From the first section of decking 36, the individual installing the dock may sink the support post 34 and its counterpart on the other side of the dock at the mid point of the second dock segment 16. Once the middle posts are in place and the frame 32 secured thereto, additional sections of decking (not shown) may be put into place at the end of the second dock section. Again, the individual installing the dock may then walk out onto the second section of decking and sink the support posts at the end of the frame 32. It should be appreciated that cross stabilizing bars are preferably used to stabilize each set of posts.

Once the outermost posts have been installed, the entire apparatus 10 may be removed from the posts supporting the previously installed dock segment, and moved out to the posts supporting the newly installed dock segment 16. The newly installed dock segment 16 then becomes the previously installed dock segment 14 and the process may be repeated. In this manner, any number of additional dock segments may be added to previously installed dock segments. Each successive dock segment may be added from the previously installed segments without the need to float segments of dock, or without requiring the installer of the dock to enter the water or utilize a boat.

It should be appreciated that to remove a segment of a segmented dock, the method of the present invention described above would be reversed. This would allow a single installer to remove a dock without requiring the person to enter the water or utilize a boat or float segments of the dock. It should also be appreciated that the present invention could be used to install different shaped docks. In particular, people desire T-shape or L-shape docks. The same method could be used to install segments necessary for the T-shape or L-shape docks. It should be appreciated that single segments may be used to form intersecting segments.

While the present invention has been described in connection with. what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

What is claimed is:

1. An apparatus for installing or removing a segment of a segmented dock including at least one previously installed segment, each of said dock segments including a frame and a removable deck, the apparatus comprising:

a suspension structure adapted to be connected to said previously installed segment, said suspension structure including a first riser mountable on a first side of said previously installed segment, and a second riser mountable on a second side of said previously installed segment, said first and second risers spaced apart a distance greater than the width of the frame of said dock segment;

at least one hinge adapted to pivotally connect the frame of said dock segment to said previously installed segment in inverted and non-inverted positions; and a frame rotator connected to said suspension structure and adapted to rotate the frame of said dock segment from said inverted position to said non-inverted position adjacent to said previously installed segment, said frame rotator including a first pulley supported by a cross member extending between said first and second risers and a first cable extending through said first pulley;

said suspension structure adapted to support the frame and the removable deck associated with said dock segment in said non-inverted position.

2. The apparatus of claim 1, wherein the frame rotator further includes a second pulley supported by said cross member and a second cable extending through said second pulley.

3. The apparatus of claim 2 which includes at least one winch adapted to tension said cables.

4. An apparatus for installing or removing a segment of a segmented dock, said segment including a support frame, mounting posts and a removable deck surface, said apparatus comprising:

a suspension structure adapted to be connected to a distal end of a previously installed dock segment, said suspension structure including at least one riser and a across member connected to said riser;

a pulley connected to the cross member of the suspension structure above the distal end of the previously installed dock segment;

a hinge adapted to pivotally connect a frame of the segment to the previously installed dock segment, said hinge enabling the frame to pivot greater than 90° from a folded position to an extended position;

a cable having a first end adapted to be connected to a distal end of the frame opposite the hinge, and a second end adapted to pass through said pulley; and a cable securing device adapted to lock said cable such that the cable supports the frame in said extended position.

5. The apparatus of claim 4, wherein the suspension structure includes an extender connected to said riser and said pulley.

6. The apparatus of claim 5, which includes a second pulley connected to the cross member, and a second cable adapted to be connected to the distal end of the frame and to pass through the second pulley.

7. The apparatus of claim 4, wherein said cable securing device includes a lockable winch.

8. The apparatus of claim 4, wherein said hinge includes a floating leaf hinge having first and second leaves.

9. An apparatus for installing or removing sections of a dock including successive dock sections having first and second ends joined by at least one hinge adapted to enable a second dock section to be rotated more than 90° while connected to a first dock section, said apparatus comprising:

a pulley;

means for suspending the pulley above the second end of the first dock section, said suspending means including a plurality of risers connectable in spaced apart relation to the first dock section at a distance wider than the width of the first dock section, and wherein the pulley is connected to a cross member extending between said risers;

a cable having a first cable end adapted to be removably attached to the second end of the second dock section and a second cable end adapted to extend through the pulley; and means for tensioning said cable, whereby said second dock section may be placed in an inverted position, the first end of the second dock section may be joined to the second end of the first dock section by the hinge, said cable may be pulled to rotate the second end of the second dock section about the hinge, the cable may be controllably released through the pulley to lower the second dock section into a desired substantially horizontal position, and said tensioning means may be used to maintain said second dock section in said substantially horizontal position.

10. The apparatus of claim 9, wherein each of said dock sections is adapted to be supported by a plurality of posts, and said risers are configured to be mounted to the posts supporting the first dock section.

11. The apparatus of claim 9, wherein said cable includes a rope.

12. The apparatus of claim 9, wherein said cable is a steel cable.

13. The apparatus of claim 9, wherein said tensioning means includes a winch.

14. An apparatus for installing or removing successive segments of a dock having a plurality of modular dock segments, each of said dock segments including one or more deck sections supported by a frame, the frame having a first end and a second end and defining a width, the frame being supported by posts, the dock further including hinges whereby the first end of one frame may be pivotally connected to the second end of an adjacent frame, said apparatus comprising:

a support frame including a pair of upstanding support members adapted to be offset mounted to a previously installed dock segment a distance greater than the width of the frame of the dock segment to be installed or removed and a pulley support connected to said upstanding support members;

a first pulley suspended from the pulley support;

a first cable adapted to be removably connected to the second end of the frame of the dock segment to be installed or removed and wound through the pulley so that the cable may be used to raise and lower the second end of the frame into a desired position; and a first winch adapted to wind the cable and temporarily hold tension thereon to support the frame of the dock segment being installed or removed.

15. The apparatus of claim 14, which includes an L-shaped mounting bracket having a first end adapted to be mounted to one of the posts of the previously installed dock segment, and a second end adapted to support one of the upstanding support members, the L-shaped bracket being configured to vertically offset said support member relative to the post.

16. The apparatus of claim 14, which includes a second pulley suspended from the pulley support; a second cable adapted to be connected to the second end of the frame and wound around the second pulley; and a second winch adapted to wind the second cable and temporarily hold tension thereto to support the frame of the dock segment being installed.

17. The apparatus of claim 14, wherein the cable is a rope.

18. The apparatus of claim 14, wherein the cable is a steel cable.

19. The apparatus of claim 14, wherein the upstanding support members include an angled portion such that the pulley support is positioned outwardly of the second end of the frame associated with the previously installed dock segment when the support frame is mounted to the previously installed dock segment.

20. The apparatus of claim 14, wherein the support frame includes a pair of stabilizing beams connected to the upstanding support members and the previously installed dock segment.

21. A method of installing a segment of a segmented dock, wherein said segment includes one or more deck sections supported by a frame, each said frame has first and second ends, and the frames are supported by a plurality of posts, said method comprising the steps of:

mounting a suspension structure to a previously installed segment;

placing a frame of said segment on the previously installed segment in an inverted position;

pivotally joining the first end of the frame of said segment to the second end of the frame of the previously installed segment;

attaching a first end of a cable connected to the suspension structure to the second end of the frame of said segment;

pulling a second end of the cable to raise the second end of the frame of said segment, and vertically rotating the frame relative to the previously installed segment;

releasing the second end of the cable in a controlled manner after the frame of said segment has been rotated past a vertical position to lower the second end of the frame of said segment to a desired position;

securing the cable to suspend the frame of said segment in the desired position;

placing a deck section on the frame of said segment;

attaching posts to the frame of said segment to support said segment; and disconnecting the cable.

22. A method of removing a segment of a segmented dock, wherein said segment includes one or more deck sections supported by a frame, each said frame has first and second ends, and the frames are supported by a plurality of posts, said method comprising the steps of:

mounting a suspension structure to an adjoining installed segment of the segment to be removed;

attaching a first end of a cable connected to the suspension structure to the second end of the segment;

securing the second end of the cable in a manner which will suspend the segment to maintain the position of the segment following removal of a plurality of the posts supporting the frame of said segment;

removing a plurality of the posts supporting the frame of said segment;

removing each of the deck sections supported by the frame of said segment;

pulling the second end of the cable to raise the second end of the frame of said segment, and vertically rotating the frame relative to the adjoining installed segment;

releasing the second end of the cable in a controlled manner after the frame of said segment has been rotated past a vertical position to lower the frame of said segment to an inverted position on the adjoining installed segment;

disjoining the first end of the frame of said segment from the adjoining installed segment; and disconnecting the cable from the segment.

23. An apparatus for installing or removing a segment of a segmented dock including at least one previously installed segment, each of said dock segments including a frame and a removable deck, said segmented dock including at least one hinge adapted to pivotally connect the frame of said segment to said previously installed segment in inverted and non-inverted positions, the apparatus comprising:

a suspension structure connectable to said previously installed segment, said suspension structure including a first riser connectable to a first side of said previously installed segment, a second riser connectable to a second side of said previously installed segment, and a cross member connected to said first and second risers, said first and second risers positionable in spaced apart relation at a distance greater than the width of the frame of said segment, said suspension structure operable to support the frame and the removable deck associated with said segment in said non-inverted position; and a frame rotator supported by said suspension structure and operable to rotate the frame of said segment between said inverted position and said non-inverted position adjacent to said previously installed segment, said frame rotator including a cable support being connected to said cross member and a cable supported by said cable support.

24. The apparatus of claim 23, wherein the cable support includes at least one pulley.

25. The apparatus of claim 23, which includes a winch operable to tension said cable.

* * * * *